United States Patent [19]

Brown et al.

[11] 4,320,836

[45] Mar. 23, 1982

[54] FLAT GLASS SHIPPING RACK

[75] Inventors: William J. Brown, Lower Burrell; James R. Rowley, Freeport, both of Pa.

[73] Assignee: PPG Industries, Inc., Pittsburgh, Pa.

[21] Appl. No.: 108,768

[22] Filed: Dec. 31, 1979

[51] Int. Cl.[3] ..... B65D 85/48

[52] U.S. Cl. ..... 206/451; 206/454

[58] Field of Search ..... 206/454, 451, 452, 599, 206/386, 448; 105/489, 467; 211/41

[56] References Cited

U.S. PATENT DOCUMENTS

| | | | |
|---|---|---|---|
| 3,963,122 | 6/1976 | Pater et al. | 206/454 |
| 3,964,608 | 6/1976 | Rowley | 206/454 |
| 3,995,738 | 12/1976 | Rowley et al. | 206/451 |
| 4,007,837 | 2/1977 | Rowley et al. | 206/454 |
| 4,010,849 | 3/1977 | Pater et al. | 206/454 |
| 4,014,435 | 3/1977 | Rowley et al. | 206/454 |

*Primary Examiner*—Joseph Man-Fu Moy
*Attorney, Agent, or Firm*—Donald Carl Lepiane

[57] ABSTRACT

A rack for shipping flat glass sheets has a slanted backwall between a pair of standards and a base to support the sheets on edge sloped toward the backwall for shipping and packing stability. A front restraint having a pair of vertical posts and sheet engaging surface therebetween is mounted in the base and urged toward the backwall against the sheet by a compression tool. A rod pivotally mounted on each of the standards is detachably secured to the post of the front restraint. Lateral motion of the sheets is eliminated by end restraints mounted on the sides of the base. An adjustable dunnage member made of interlocking polystyrene pieces is used as a filler to secure less than a full load of sheets in the rack. An adjustable outrigger mounted on the base is employed as a filler for space between racks when loaded on a railcar or trailer.

25 Claims, 20 Drawing Figures

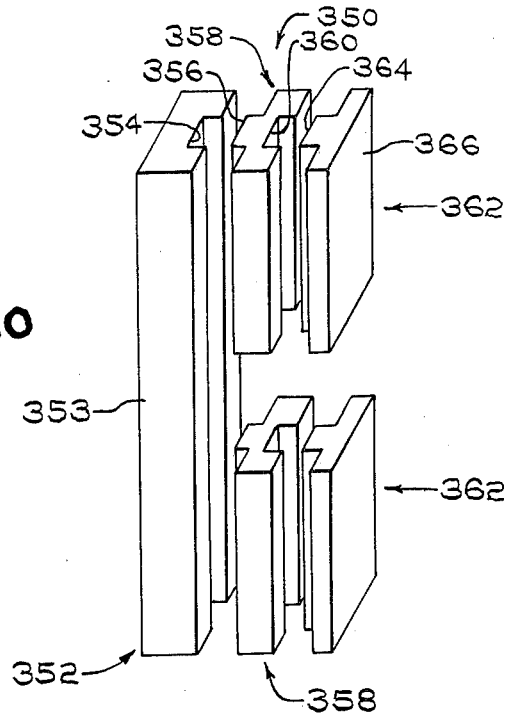
FIG. 20
FIG. 9
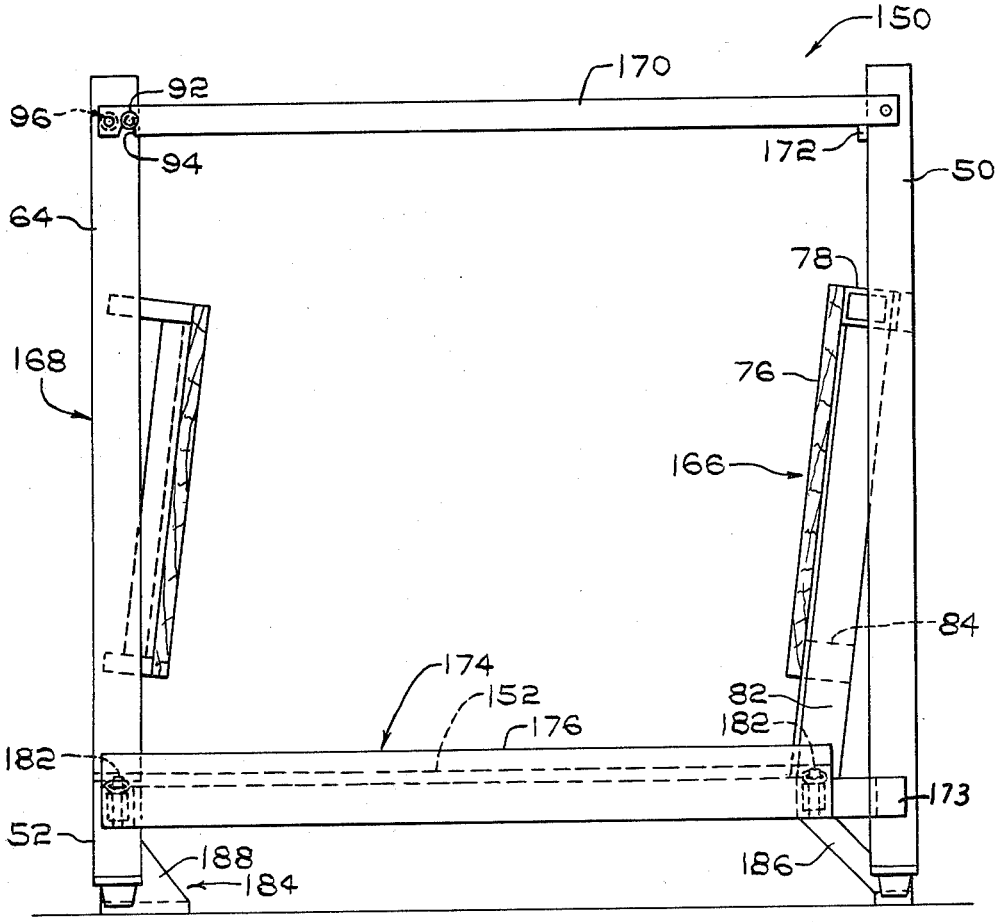

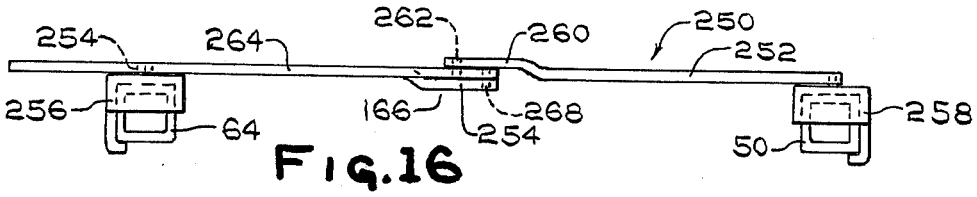
FIG. 16
FIG. 15
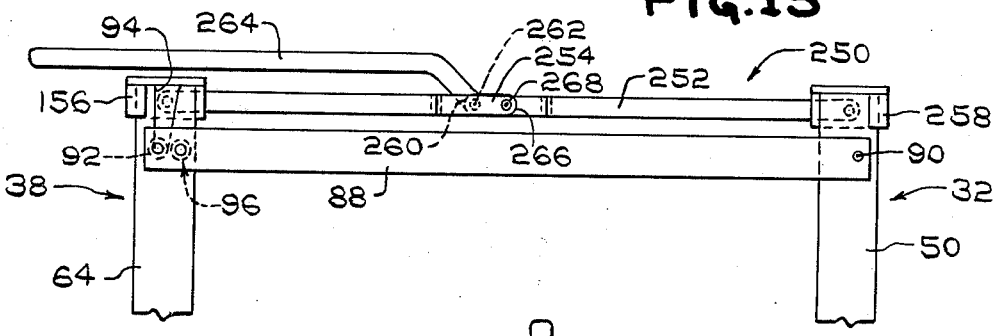
FIG. 14
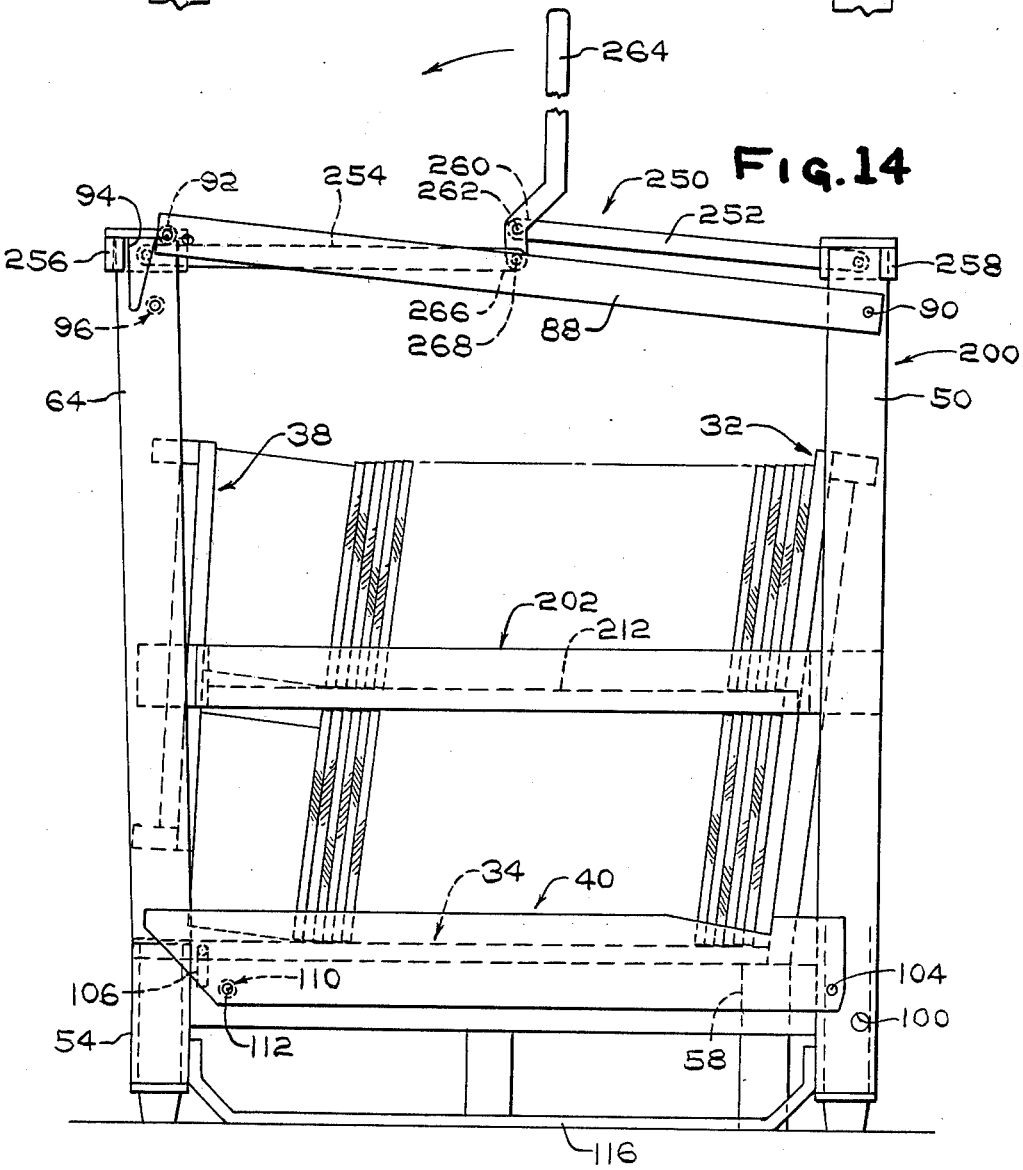

FLAT GLASS SHIPPING RACK

BACKGROUND OF THE INVENTION

Field of the Invention

This invention relates to sheet shipping racks and in particular, to racks for shipping flat glass sheets.

Description of the Prior Art

In the prior art there are taught various types of racks for shipping articles, e.g., U.S. Pat. Nos. 3,887,071 and 3,963,122 teach racks for shipping automotive lites; U.S. Pat. Nos. 3,939,780; 3,939,978 and 3,955,676 teach racks for shipping flat glass sheets and U.S. Pat. No. 3,863,799 teaches bins for shipping glass sheets of various configurations and dimensions. Although each of the prior art shipping racks or bins are acceptable for their intended purposes, it would be advantageous to provide a rack for shipping flat glass sheets that provides a planar supporting back wall and a planar front restraint to uniformly distribute restraining forces over an increased surface area of the sheets and provide for removal of the sheets from the side or front of the rack for ease of unloading the rack.

SUMMARY OF THE INVENTION

This invention relates to a rack for shipping sheets, e.g. glass sheets having a base secured to a backwall having a planar sheet receiving surface and a front restraint or gate having a planar sheet engaging surface. Facilities secure the front restraint in fixed spaced relationship to the backwall such that the planar engaging surface of the backwall is generally parallel to the planar sheet engaging surface of the front restraint.

This invention also relates to a tool for biasing a gate or front restraint towards the backwall of a rack. The tool has a rod having one end detachable securable to the gate and another rod having its end detachably securable to the backwall. The first and second rod are moved relative to one another for example by way of a handle pivotally mounted to the opposite end of each rod to bias the front restraint toward the backwall.

This invention also relates to an adjustable dunnage element which has a first member having a groove in a major surface and a second member having a protrusion insertable in the groove. Additional intermediate members having a protrusion which is insertable in the groove of the first member and a groove for receiving the protrusion of additional second members may be used to increase the thickness of the dunnage element.

Still further this invention relates to an end restraint for a rack of the type having a backwall secured to a base for supporting the sheets in a generally vertical position on an edge and includes a plate having one end pivotally mounted to the base and the other end detachably secured to the base.

Still further, this invention relates to an outrigger for altering the dimensions of the base of a rack to eliminate or minimize the use of dunnage between racks loaded on a railcar or truck. The outrigger includes a plate slideably mounted on the base of the rack and having holes therein alignable with a hole in the base for securing the plate in a selected one of a plurality of positions by a pin inserted through the aligned holes.

In addition, this invention relates to an end restraint having an end securable to the backwall of a rack and the other end securable to the front restraint to secure sheets against longitudinal displacement. The end restraint is normally employed as an upper restraint when tiers of sheets are.

This invention further relates to a method of loading sheets on a rack. The rack being of the type having a backwall secured to a base and includes the steps of loading the sheets on the rack in a generally vertical position supported by the backwall with an edge supported by the base. Thereafter a front restraint is mounted in the base and urged toward the backwall to urge the sheets against one another between the front restraint and the backwall. Thereafter the front restraint is secured in position.

BRIEF DESCRIPTION OF THE DRAWING

FIG. 9 is a side view of the rack shown in FIG. 8;

FIG. 14 is a side view of the rack shown in FIG. 11 illustrating a biasing tool in a nonbiasing position, the biasing tool incorporating features of the invention urges the front restraint toward the backwall about the loaded sheets.

FIG. 15 is a fragmented side view of the rack shown in FIG. 14 illustrating the biasing tool in the biasing position;

FIG. 16 is a plan view of FIG. 15;

FIG. 20 is an isometric illustrating an adjustable spacer incorporating features of the invention.

DETAILED DESCRIPTION OF THE INVENTION

Figure 1:
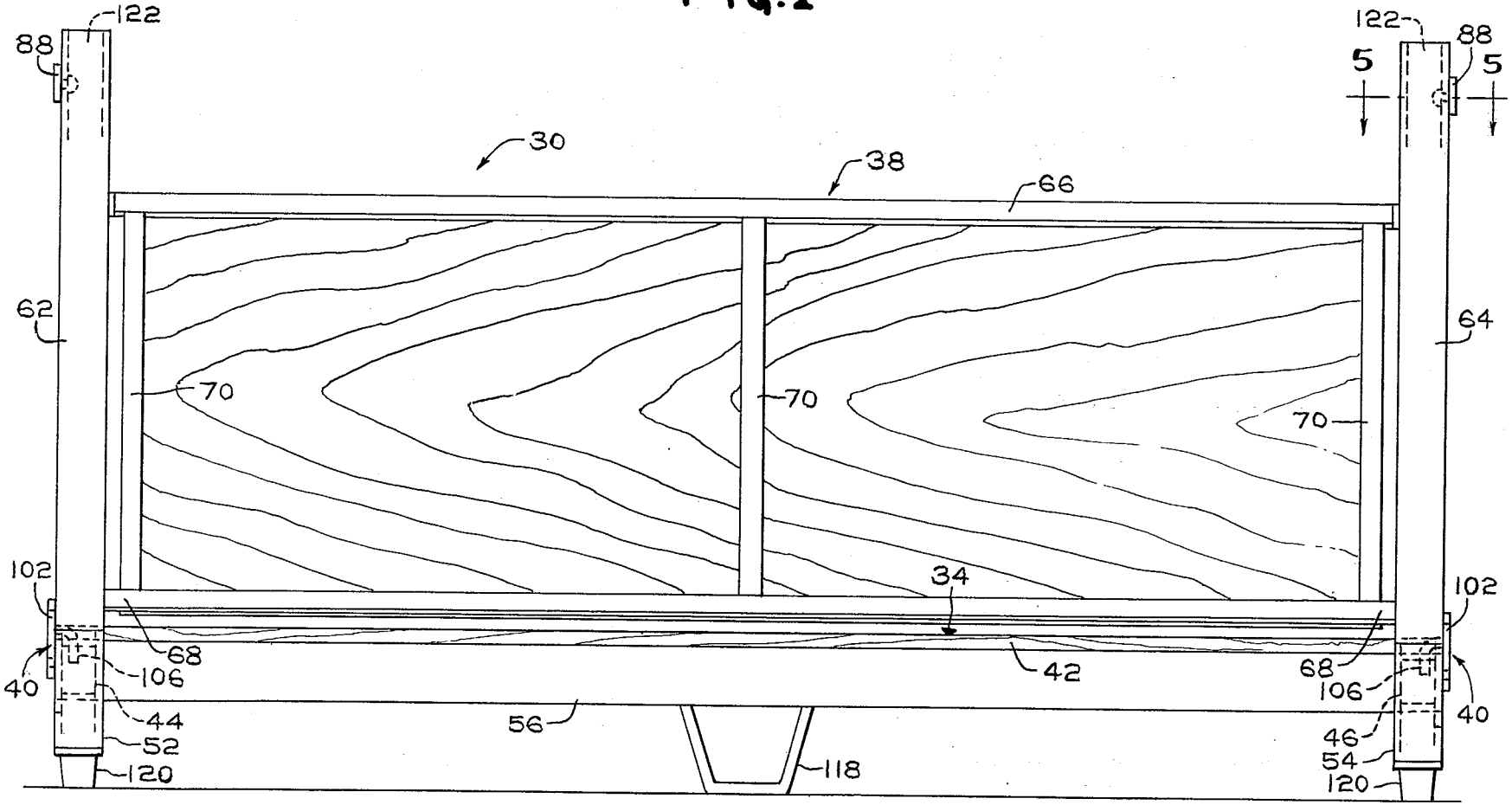
FIG. 1 is a front elevated view of a sheet shipping rack incorporating features of the invention.
Figure 2:
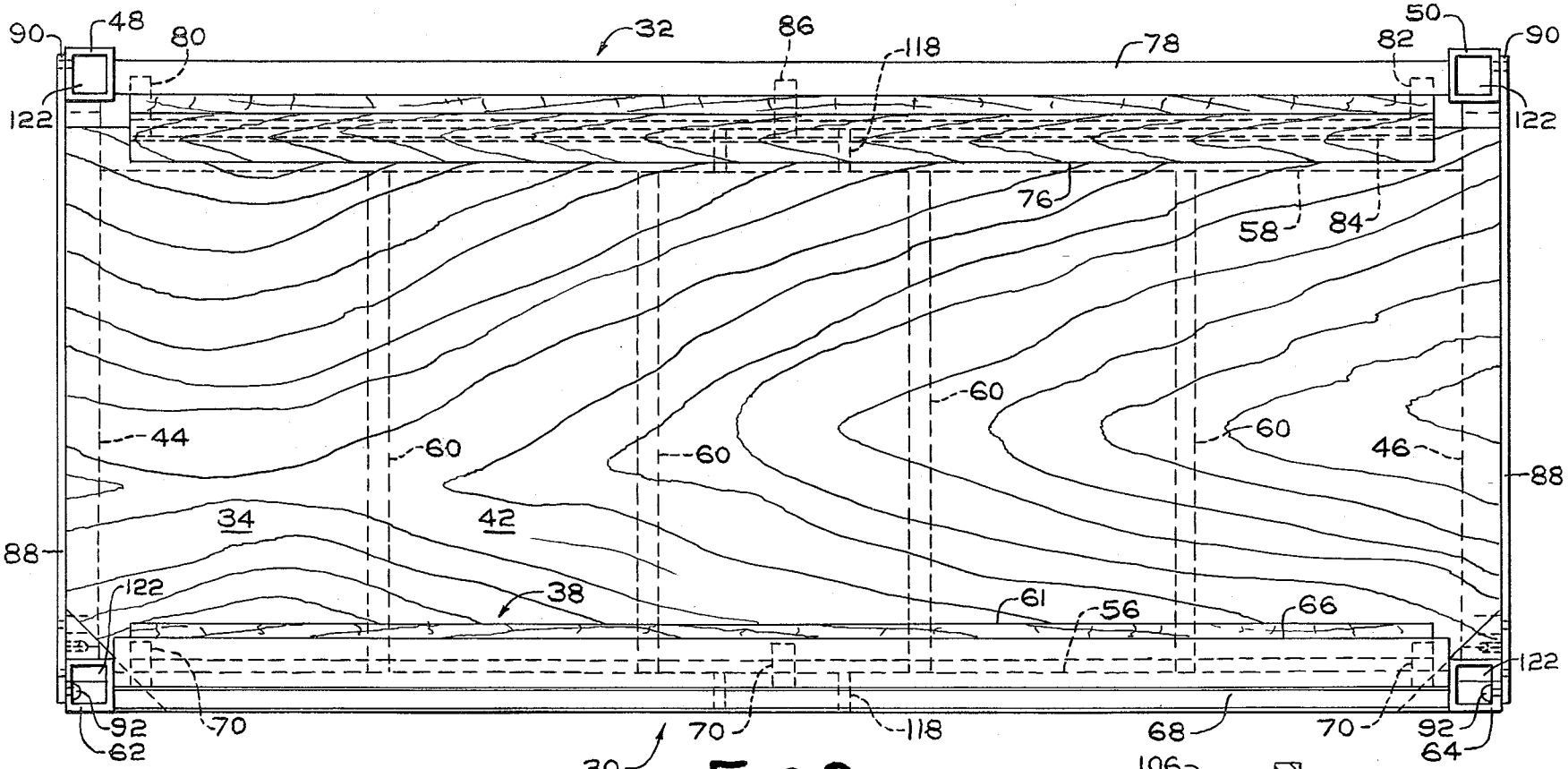
FIG. 2 is a plan view of the rack shown in FIG. 1.
Figure 3:
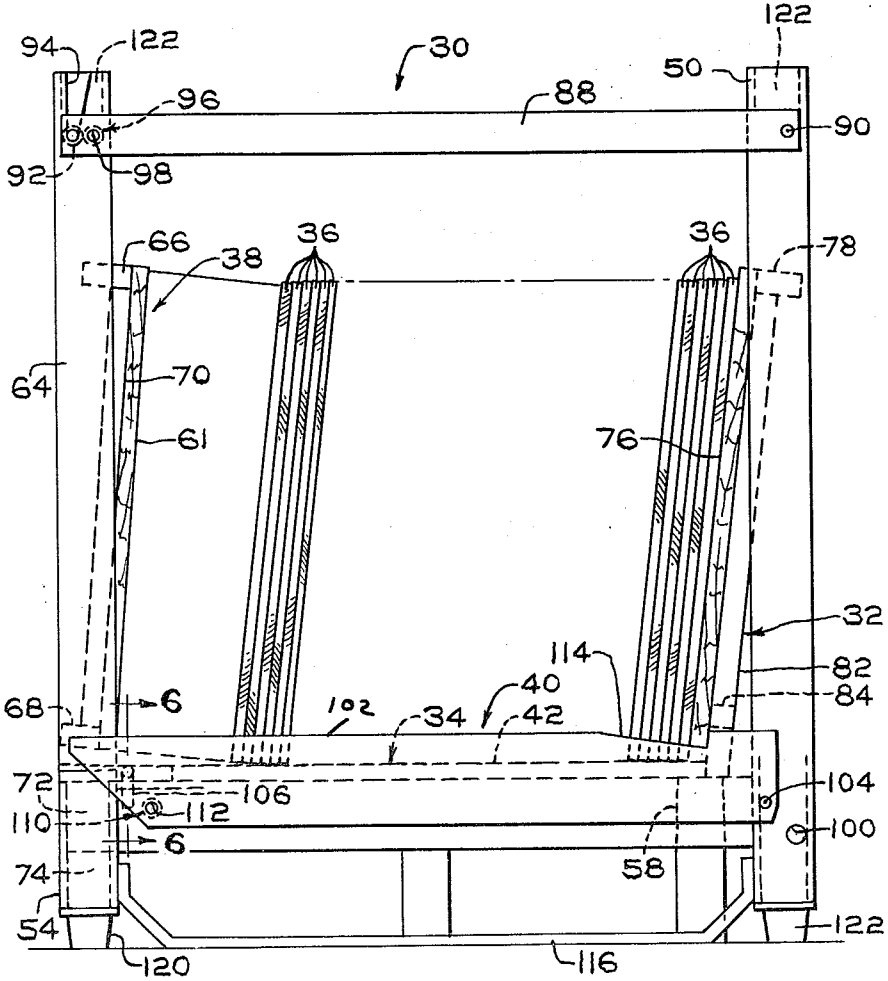
FIG. 3 is a side view of the rack shown in FIG. 1 having sheets secured therein in accordance to the teachings of the invention.

In the following discussion like numerals refer to like elements. With reference to FIGS. 1–4 there is shown a shipping rack 30, incorporating features of the invention, having backwall 32 secured to base 34 for supporting sheets 36 in a generally vertical position as shown in FIG. 3. Sheet restraint or gate 38 is detachably secured to the base 34, in a manner to be discussed below, to restrain or prevent movement of the sheets 36 toward and away from the back wall 32, i.e. reciprocal lateral and/or oscillatory motion of the sheets. Longitudinal motion of the sheets 36 is restrained or prevented by an end restraint 40 mounted on each side of the base 34. The base 34 includes a deck 42, e.g. a 0.75 inch (1.19 centimeter) thick plywood sheet supported on a plurality of stringers and spacer bars innerconnected to one another in any convenient manner. For example and with reference to FIGS. 1 and 2, end spacer bar 44 and 46, e.g. 3 inches (7.62 centimeters) by 2 inches (5.08 centimeters) 11 gauge steel tubing is secured at an end to standard 48 and 50, e.g. a 2.5 inches (6.35 centimeters) square 11 gauge steel tubing, respectively, of the backwall 32 and at the other end to leg 52 and 54 e.g. a 2.5 inches (6.35 centimeters) square 11 gauge steel tubing, respectively. Front stringer 56, e.g. 3 inches (7.62 centimeters) by 2 inches (5.08 centimeters ) 11 gauge steel tubing is secured to and between the legs 52 and 54 and back stringer 58 similar to the front stringer 56 is secured to and between the end spacer bars 44 and 46 spaced from the front stringer 56. Secured to and between the front and back stringers 56 and 58 are a plurality of intermediate spacers 60 e.g. 3 inches (7.62 centimeters) by 1 inch (2.54 centimeters) 11 gauge steel tubing.

Figure 4:
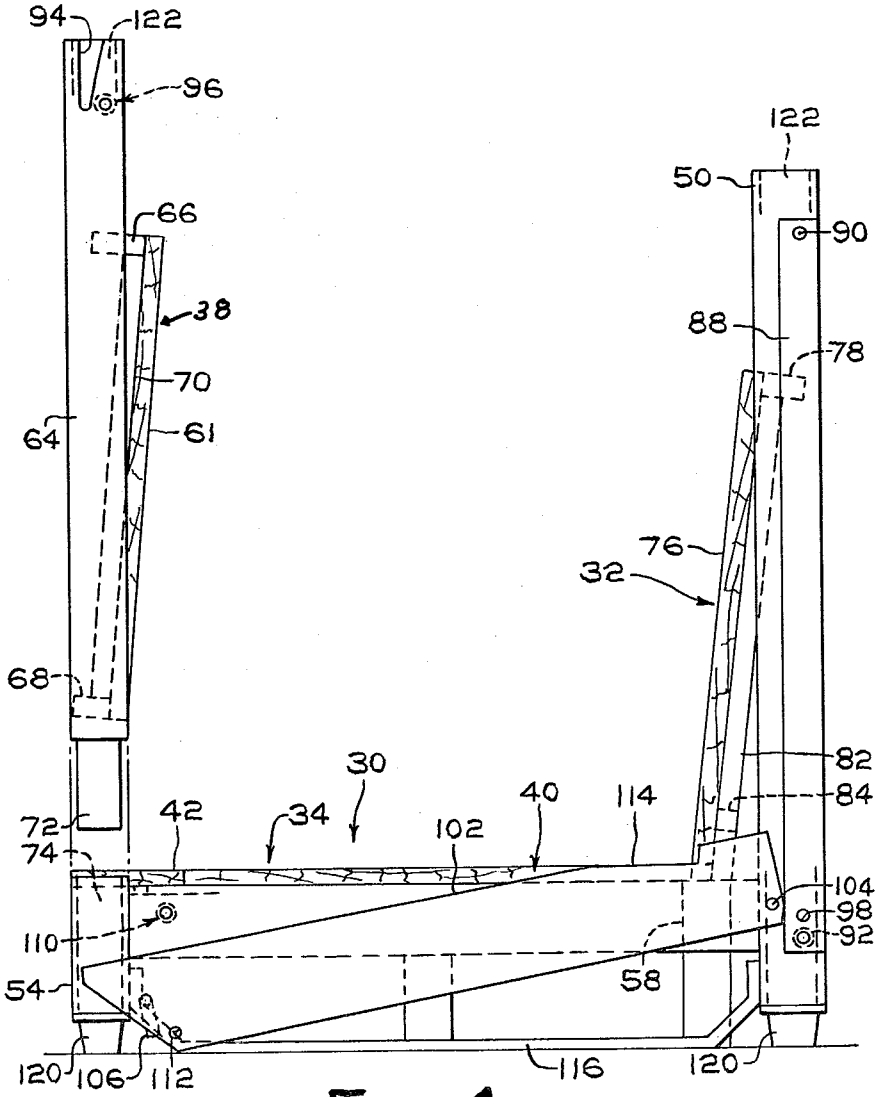
FIG. 4 is a side view of the rack shown in FIG. 1 illustrating the mounting of the front restraint on the base of the rack.

The gate 38 has a sheet engaging plate 61 e.g. a $\frac{5}{8}$ inch (1.91 centimeter) thick plywood sheet secured between a pair of posts 62 and 64 e.g. 2.5 inches (6.35 centimeters) square 11 gauge steel tubing by a plurality of stringers and spacer bars interconnected in any convenient manner. For example and with reference to FIG. 1, top stringer 66 e.g. a 3 inch (7.65 centimeters) by 1 inch (2.54 centimeters) 11 gauge steel tubing and bottom stringer 68 e.g. a 1 inch (2.54 centimeter) square 11 gauge steel tubing are secured to and between the posts 62 and 64 with the top stringer 66 spaced from the bottom stringer 68. The top stringer 68 extends beyond the plane containing the posts 62 and 64 to slope the plate 61 as shown in FIGS. 3 and 4 for reasons to be discussed below. A plurality of vertical spacer bars 70 e.g. outer spacer bars of 1 inch (2.54 centimeters) by 1 inch (2.54 centimeters) steel angle irons and an intermediate spacer bar of a 1 inch (2.54 centimeters) square 11 gauge steel tubing are secured between the top and bottom stringer 66 and 68 respectively. The gate 38 is mounted on the base 34 by shaping end 72 of the posts 62 and 64 for insertion into hole 74 of the legs 52 and 54 of the base 34 as shown in FIGS. 3 and 4.

The backwall 32 has a supporting plate 76 e.g. a $\frac{5}{8}$ inch (1.6 centimeters) thick plywood sheet secured between the standards 48 and 50 by stringers and spacers innerconnected in any convenient manner. For example and with reference to FIGS. 2–4, top stringer 78 e.g. 3 inches (7.62 centimeters) by 2 inches (5.08 centimeters) 11 gauge steel tubing is secured to and between the standards 48 and 50. A pair of outer spacer bars 80 and 82 e.g. a 1 inch (2.54 centimeters) square 11 gauge steel tubing are secured at an end to the top stringer 78 and at the other end to the back stringer 58 of the base 34. A bottom stringer 84 e.g. a 1 inch (2.54 centimeters) square 11 gauge steel tubing is secured to and between the outer spacer bars 80 and 82. An intermediate spacer bar 86 e.g. a 1 inch (2.54 centimeters) square 11 gauge steel tubing is secured to and between the top and bottom stringers 78 and 84 respectively for additional structural stability. The supporting plate 76 is sloped with respect to the base 34 e.g. 5° slope for packing and unloading stability and to increase the strength of the standards 48 and 50 with respect to lateral movement. The plane of the sheet engaging plate 61 of the gate 38 is generally parallel to the supporting plate 76 of the backwall 32 to capture the sheets 36 therebetween.

The gate 38 is detachably secured in spaced relationship to the backwall 32 about the sheets by locking bars 88. With reference to FIGS. 3 and 4, the locking bar 88 e.g. 1 $\frac{1}{2}$ inches (3.81 centimeters) wide and $\frac{3}{8}$ inch (0.96 centimeter) thick steel bar at each side of the rack 20 has an end pivotally mounted at 90 e.g. by a steel rod and carter pin assembly to the standard 48 and 50. The other end of the locking bars 88 each have a headed stud 92 slideable in outwardly slanting groove 94. The locking bars 88 are secured in position by a spring biased pin assembly 96 mounted in each post 62 and 64 cooperating with hole 98 in the locking bar 88. With reference to FIG. 3, hole 100 in each of the standards 48 and 50 adjacent their bottom end receives the headed stud 92 of the locking bar 88 to prevent movement thereof during shipment of the empty rack.

Figure 6:
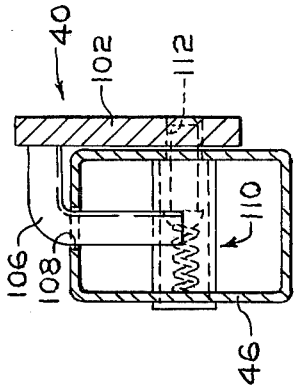
FIG. 6 is a view taken along lines 6—6 of FIG. 3.
Figure 5:
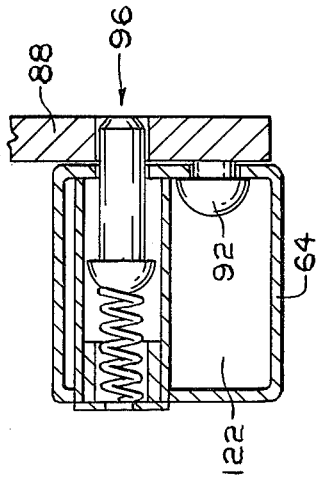
FIG. 5 is a view taken along lines 5—5 of FIG. 1.

Longitudinal movement of the sheets 36 is restrained by the end restraints 40 secured in position in any convenient manner. For example and with reference to FIGS. 1–4 and 6, each end restraint 40 includes a plate member 102 e.g. a 4 inches (10.16 centimeters) wide and $\frac{3}{8}$ inch (0.95 centimeters) thick steel plate having one end pivotally mounted and captured at 104 to its respective standard 48 or 50 by a $\frac{1}{2}$ inch (1.27 centimeters) diameter rod and cotter pin assembly. The other end of the plate member 102 has a hook 106 e.g. a $\frac{1}{2}$ inch (1.27 centimeters) L-shaped diameter steel rod (see FIG. 6) having free end insertable in one hole 108 in the spacer bars 44 and 46. A biased pin assembly 110 mounted in each end spacer bar 44 and 46 cooperates with hole 112 in the plate member 102 to lock or secure the end restraint in position. Referring now to FIGS. 3 and 4 a cutout 114 in the plate member 102 sets the end restraint 40 below the plane of the base 34 for side removal of the sheets 36.

Although not limiting to the invention, a stabilizer bar 116 of the type known in the art may be provided under each of the outside spacer bars 44 and 46. Further, a foot 118 may be provided under the front and back stringers 56 and 58 for structural stability. Loaded racks may be stacked by inserting end portions 120 of the standards 48 and 50 and legs 52 and 54 of a top rack into cavity 122 of the standards 48 and 50 and posts 62 and 64 of the bottom rack.

Figure 7:
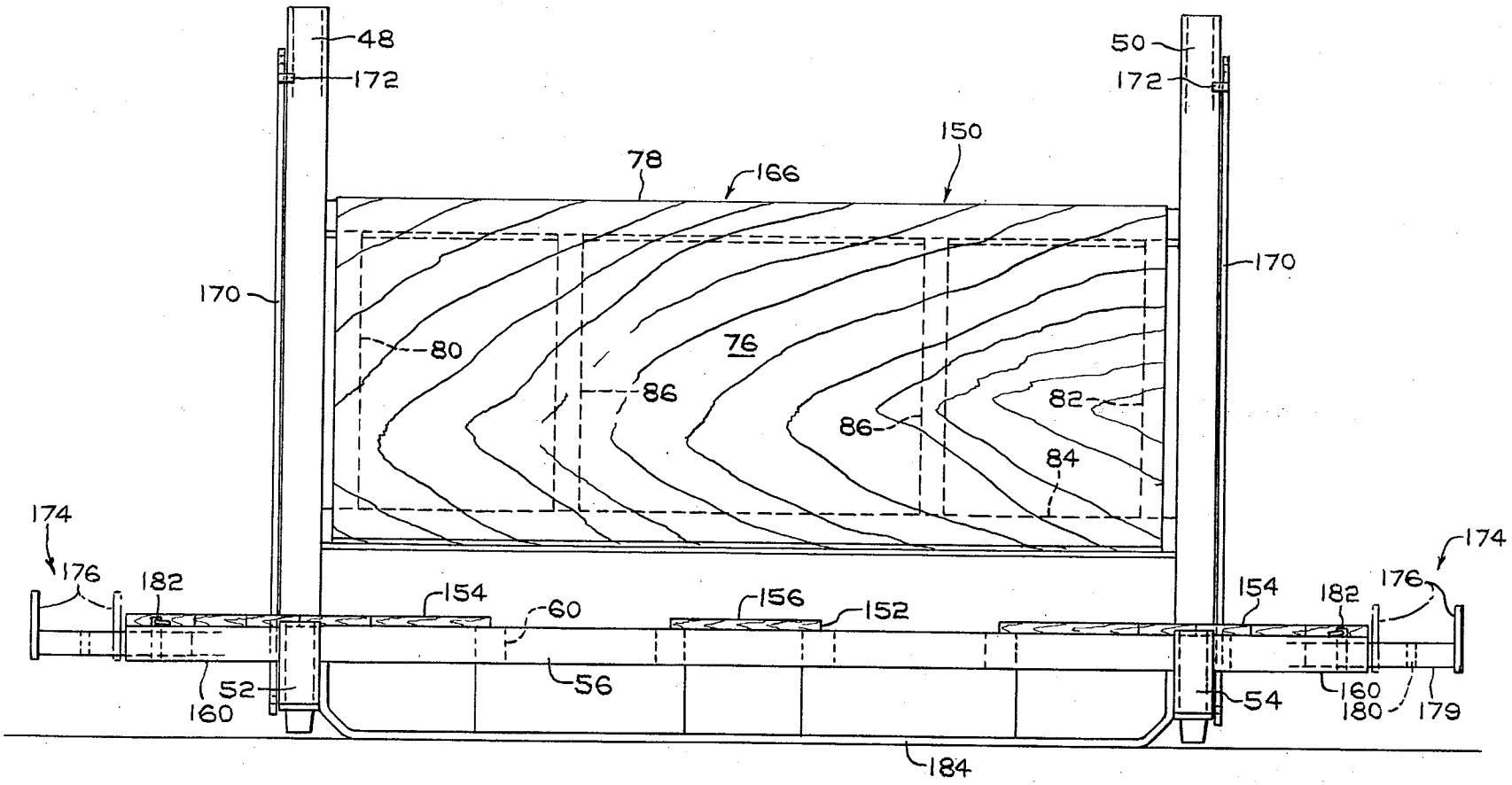
FIG. 7 is a front elevated view of another embodiment of a sheet shipping rack incorporating features of the invention and having the front restraint removed.
Figure 8:
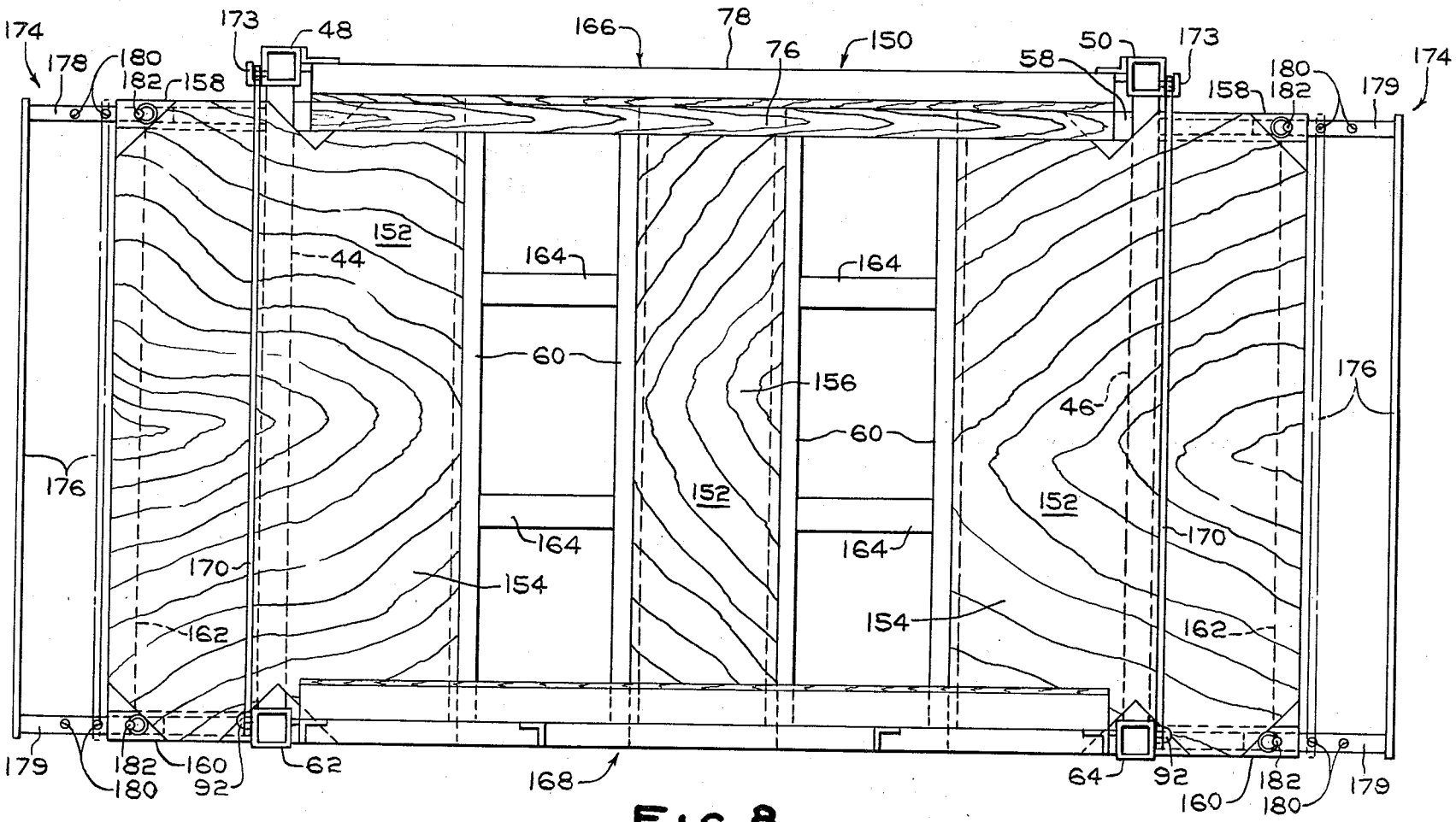
FIG. 8 is a plan view of the rack shown in FIG. 7 having the front restraint secured in position.

Shown in FIGS. 7–9 is rack 150 similar to the rack 30 shown in FIGS. 1–6 with the following difference. Base 152 of the rack 150 includes a pair of outer support plates 154 and an intermediate support plate 156, e.g. $\frac{1}{2}$ inch (1.27 centimeters) thick plywood sheet, supported on stringer and spacer bars interconnected to one another. For example and with reference to FIGS. 7 and 8, the end spacer bars 44 and 46, standards 48 and 50, legs 52 and 54, front and back stringers 56 and 58, respectively, and spacers 60 are interconnected in a similar manner as for the rack 30 shown in FIGS. 1–6. The base 152 further includes extensions 158 and 160 e.g. 2 inch (5.08 centimeters) square 11 gauge steel tubing extending outwardly from each of the end spacer bars 44 and 46 with the extension 158 axially aligned with the back stringer 58 and the extensions 160 axially aligned with the front stringer 56. A spacer member 162 e.g. a 2 inches (5.08 centimeters) square 11 gauge steel tubing maintains the extensions 158 and 160 in spaced relationship to one another and provide additional support for the outer support plates 154. Intermediate struts 164 e.g. 2 inches (5.08 centimeters) square 11 gauge steel tubing are provided between adjacent spacers 60 as shown in FIG. 8 to prevent damage to the sheets by forks of lifting equipment (not shown) normally employed to move loaded racks.

Referring to FIG. 7, the back wall 166 includes the support plate 76 secured to the top stringer 78, bottom stringer 84, end spacer bars 80 and 82, and intermediate spacer bars 86 interconnected in a similar manner as similar elements of the back wall 32 of the rack 30 shown in FIGS. 1–5 are interconnected. Referring to FIGS. 8 and 9 front restraint or gate 168 of the rack 150 is constructed in a similar manner as the gate 38 of the rack 30 of FIGS. 1–6. The gate 168 is held in spaced relation to the back wall 166 by locking bar 170 similar to the locking bar 88 of the rack 30 except that the posts 62 and 64 of the front restraint 168 have the headed stud 92 and the locking bar 170 has the outwardly sloping groove 94. A stop 172 e.g. a ½ inch (1.27 centimeters) wide and ¼ inch (0.64 centimeters) thick steel plate is provided on each of the standards 48 and 50 to prevent counterclockwise rotation of the locking bar 170 as viewed in FIG. 9 onto the top of the loaded sheets. During shipment of empty racks the locking bar 170 may be secured in a clip 173 e.g. a 2 inch (5.08 centimeters) steel angle mounted on each of the standards 48 and 50 as shown in FIGS. 8 and 9. End restraint on each side of the rack 150 may be similar to the end restraint 40 of the rack 30 or may be an adjustable type end restraint. For example and with reference to FIGS. 7 and 8, adjustable end restraint 174 includes a plate member 176, e.g. a 4 inches (10.16 centimeters) wide by ⅜ inch (0.92 centimeters) thick steel plate having a pair of spaced elongated members 178 and 179 slideable in the ends of the extensions 15 and 160 respectively. The end restraints 174 are adjustable and securable in position by providing a plurality of holes 180, e.g. 9/16 inch (1.64 centimeters) diameter holes in each of the elongated members 178 and 179 and a hole through the extensions 158 and 160. A pin 12 is inserted into the aligned holes of the extensions 158 and 160 and members 178 and 179. The rack 150 has a stabilizer bar 184 of the type known in the art under the front stringer 56 of the base 152 between the legs 52 and 54 and a stabilizer bar 186 under the back stringer 58 of the base 150 as shown in FIGS. 7 and 8. The stabilizer bar 184 and 186 which are similar in construction to the stabilizer bar 116 of the rack 30 extend beyond the ends of the legs 52 and 54 and standards 48 and 50 as shown in FIG. 7 and 9 for convenient engagement by conveying equipment.

Figure 10:
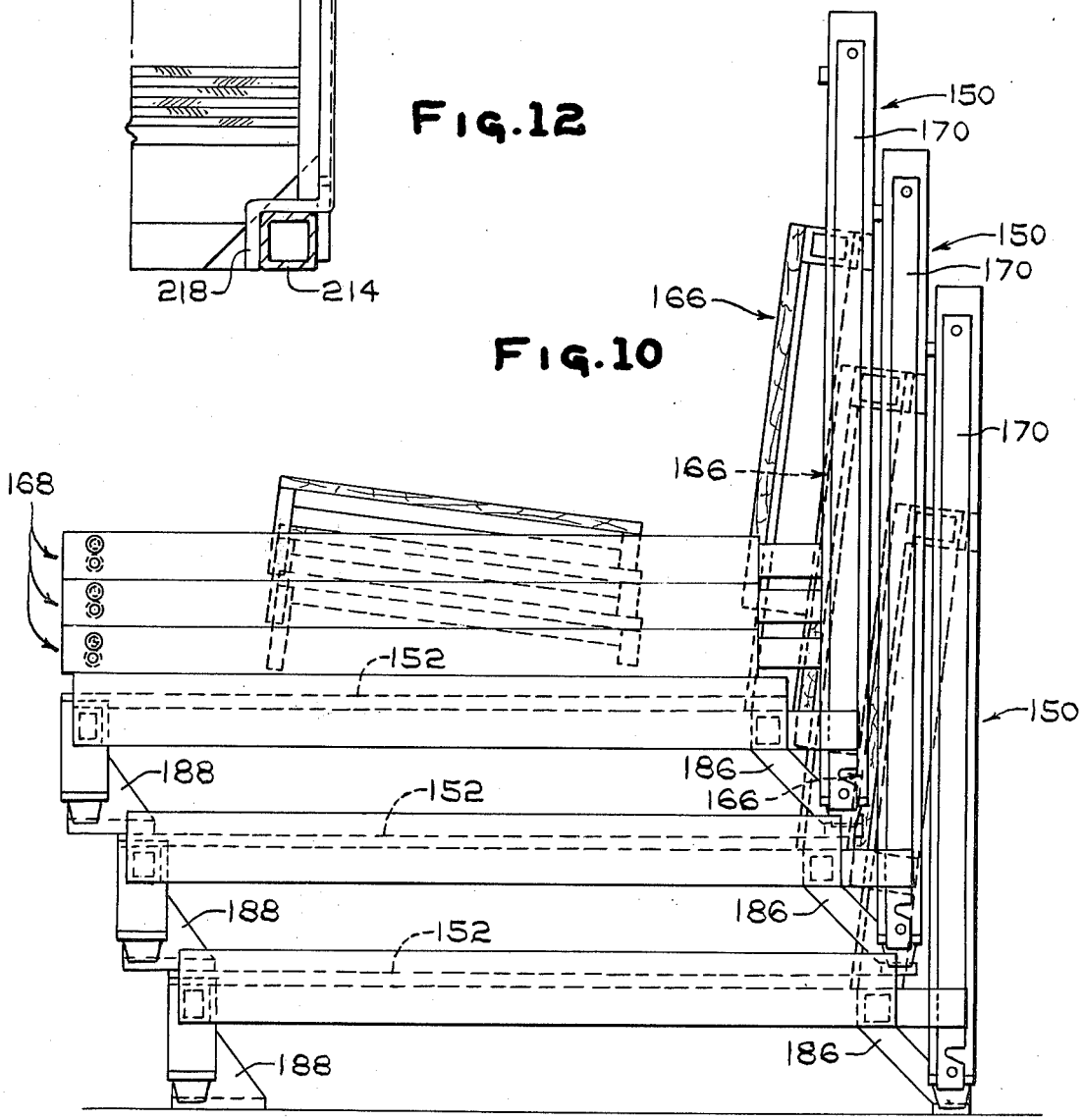
FIG. 10 is a side view of nested racks of the type shown in FIGS. 7–9.

With reference to FIG. 10, the racks 150 are nested by slanting the stabilizer bar 186 toward the standards 48 and 50 and providing a spacing between the bottom of the supporting plate 76 of the backwall 66 and plate 176 of the base 152 for receiving the runners 186 of the nested top adjacent rack. The front stabilizer bar 184 has a centrally located foot 188 which rests on the base 152 of the bottom adjacent nested rack. The spacer bars 80 and 82 of the backwall 166 are spaced from their adcent standard 48 or 50 for insertion between standards 48 and 50 of the backwall 166 of the top adjacent nested rack. The spacing between the outer vertical spacer bars 70 and adjacent posts 62 and 64 of the gate 168 are spaced for nesting gates 168.

Figure 12:
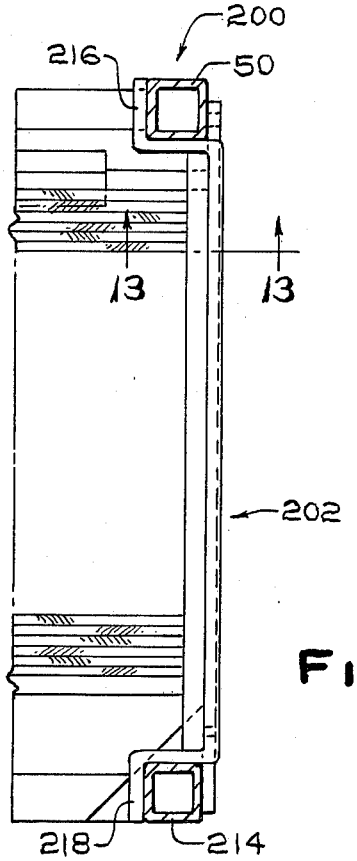
FIG. 12 is a view taken along lines 12—12 of FIG. 11.
Figure 13:
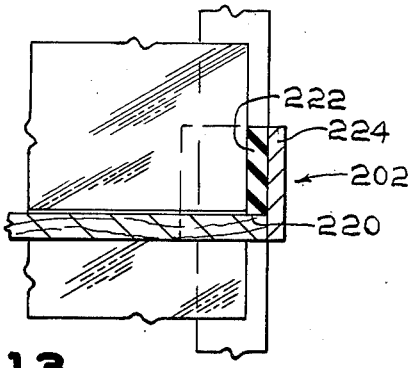
FIG. 13 is a view taken along lines 13—13 of FIG. 12.

The racks 30 and 150 may be constructed to any dimension for shipping rows or tiers of sheets, for example and with reference to FIGS. 11–14, the rack 200 which is similar to the rack 30 of FIGS. 1–6 is provided with upper end restraints 202 for shipping tiers 206 of sheets. Further, each of the tiers may have packs or rows 208 of loose sheets separated by dunnage, e.g. wood, cardboard or plastic spacers 210. The rack 200 includes the backwall 32, base 34, gate 38, end restraints 40 and locking bars 88. The tiers 206 and rows 208 of the sheets may be loaded in any convenient manner. For example, the bottom tier 206 as viewed in FIG. 11 may be first loaded with rows 208 of sheets afterwhich a base 210, e.g. a ½ inch (1.27 centimeters) thick plywood sheet 212 is mounted on top of the packed sheets. A dummy post 214 similar to the post 62 or 64 of the gate 38 is mounted in hole 74 of one of the legs 52 or 54 of the base 32. Ends 216 and 218 of the upper end restraint 202 are shaped, e.g. a 3 inch (7.62 centimeters) wide by ⅜ inch (0.95 centimeter) thick steel bar having L-shaped ends as shown in FIG. 12 to engage the standard 50 and dummy post 214, respectively. The end restraint 202 has a ledge 220 for nesting the end restraint on the base 212. In the instance where the sheets are glass sheets the ledge 220 may be formed by providing a rubber strip 222, e.g. a 2¼ inches (5.72 centimeters) by ½ inch (1.27 centimeters) thick rubber strip adhered to the metal bar 224. After the base 212 is loaded with spaced rows 208 of loose sheets, an end restraint 202 is mounted at the other end of the second tier. The dummy post 214 is removed and the end 72 of the post 62 and 64 of the gate 38 is mounted in the hole 74 of the legs 52 and 54 respectively of the base 34. The end 218 of the end restraints 202 is thereafter mounted about a respective one of the gate posts 62 and 64 as the gate is set in position.

The gate 38 is biased toward the backwall 32 against the sheets 36 in any convenient manner as the bar 88 or 170 is locked to the gate post 62 or 64. For example and with reference to FIGS. 14–16, there is shown a compression bar 250 having rigid, elongated members 252 and 254, e.g. 1½ inches (3.81 centimeters) wide and ⅜ inch (0.92 centimeters) thick steel bar each having a post or standard engaging end 250 for receiving the top of a gate post or backwall standard. End 260 of the member 252 is pivotally mounted at 262 to handle 264 and end 266 of the member 254 is pivotally mounted at 268 to handle 264 as shown in FIGS. 15 and 16 such that moving the handle from the vertical position, i.e. a non compression or initial position as shown in FIG. 14 to the horizontal position, i.e. a compression or load position as shown in FIGS. 15 and 16 to urge the engaged post 64 of the gate 38 toward the backwall 32 to secure the lash bar 88 or 170 to the gate post 62 and 64.

Figure 17:
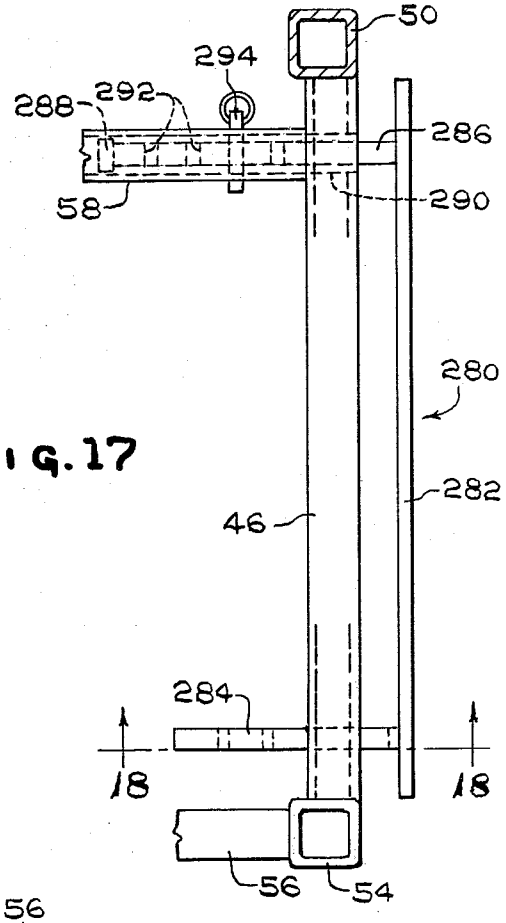
FIG. 17 is a fragmented plan view of an end restraint incorporating features of the invention mounted on the base of a rack.
Figure 18:
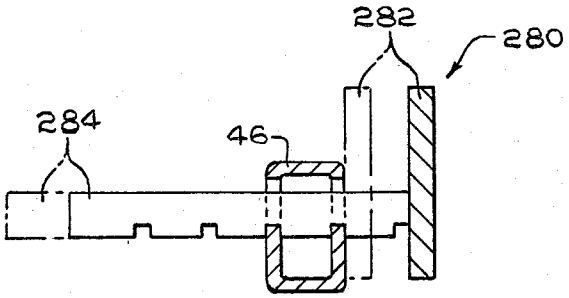
FIG. 18 is a view taken along lines 18—18 of FIG. 17.

Shown in FIGS. 17 and 18 is another embodiment of a longitudinally adjustable and pivotally mounted end restraint incorporating features of the invention which may be used with the previously discussed racks. The end restraint 280 has a plate member 282 having an elongated toothed member 284 slideable into and engageable with walls of the end spacer bar 46 as shown in FIG. 18 to secure the end restraint in a selected longitudinal position. The opposite end of the plate 282 has a rod 286 pivotally mounted and captured in the spacer bar 46 in any convenient manner and extending into the back stringer 58. The rod 286 may be captured in the bar 46 by providing the rod 286 with a headed end 288 having a diameter greater than sleeve 290 which is secured in the spacer bar 46 in any convenient manner. The rod 286 is provided with a plurality of holes 292 each of which are alignable with hole in the back stringer 58 when the end restraint 280 is in a selected longitudinal position. Thereafter pin 294 is inserted in the aligned holes to prevent pivotal motion of the end restraint.

Figure 19:
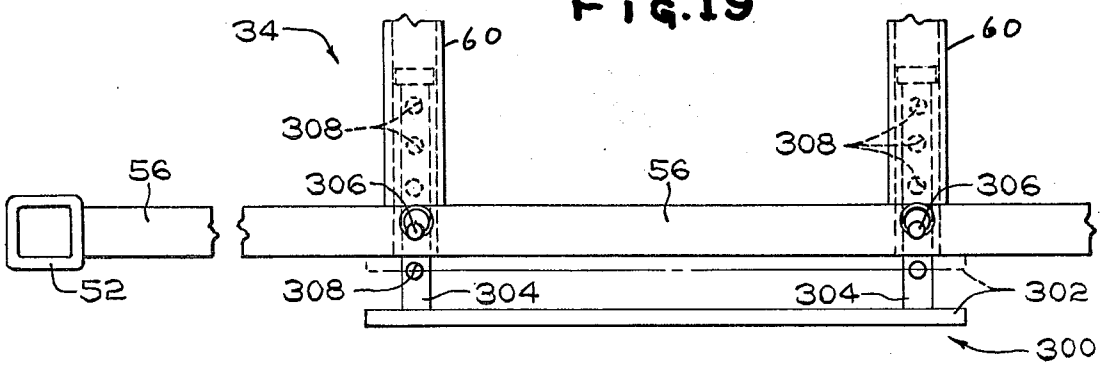
FIG. 19 is a fragmented plan view of a shipping rack illustrating an outrigger incorporating features of the invention; the outrigger slideably mounted on the base of a rack.

With reference to FIG. 19 there is shown an outrigger 300 incorporating features of the invention which may be used in place of dunnage for securing racks in position in a truck or railcar. Dunnage is normally used between adjacent racks to take up the space therebetween and urge them against the outerwalls of the railcar. The outrigger 300 of the instant invention expands the sides of the rack e.g. the front and back sides to eliminate the need for dunnage. The outrigger 300 as shown in FIG. 19 includes a plate 302 mounted on spaced elongated bars 304 slideably captured in front stringer 56 and extending into spacer bar 60 of the base 34. The outrigger 300 is secured in position by a pin 306 passing through aligned hole in the front stringer 56 and one of a plurality of holes 308 in the bars 304 of the outrigger 306.

Figure 11:
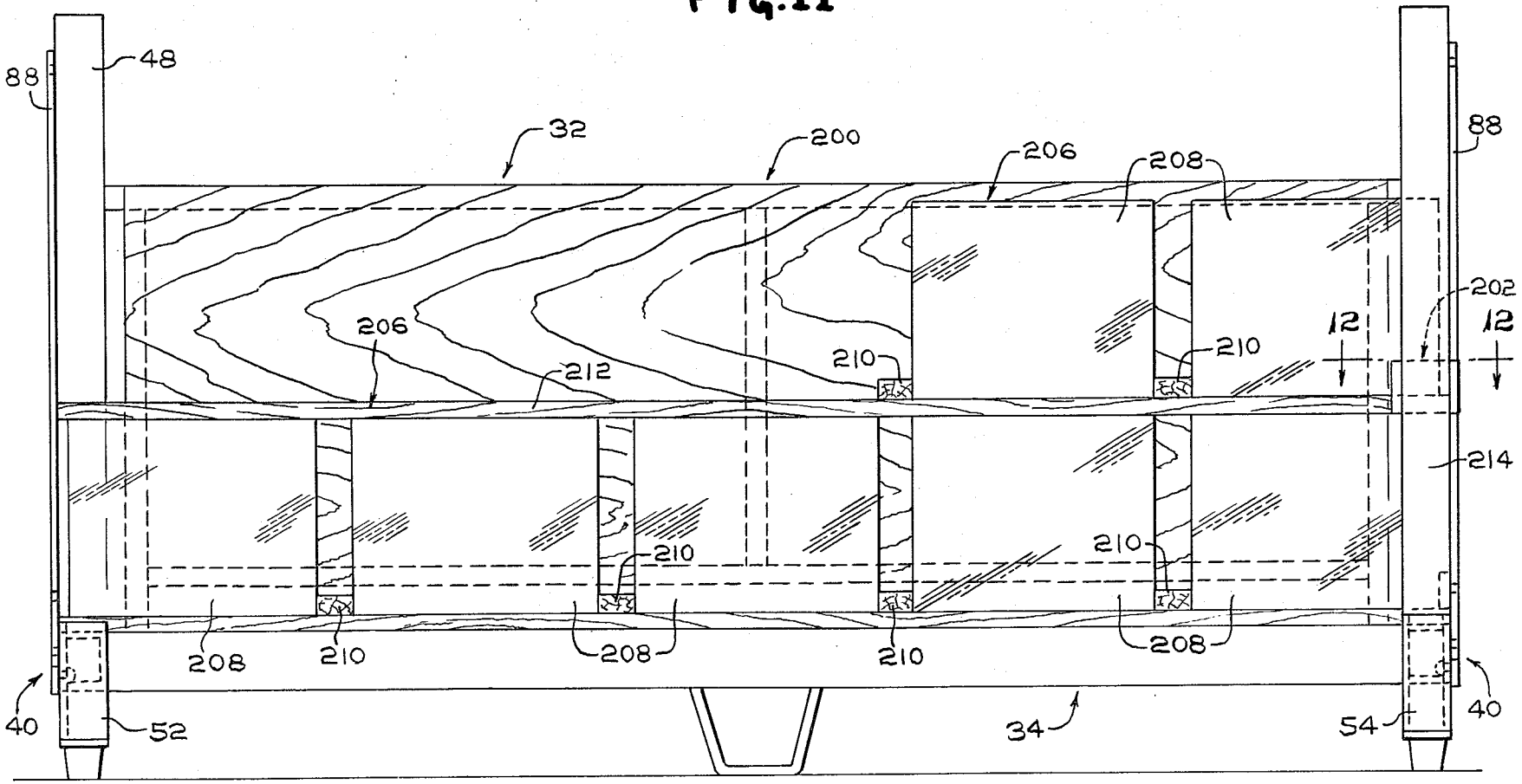
FIG. 11 is a front elevated view of a further embodiment of a sheet shipping rack illustrating rows and tiers of sheets mounted therein in accordance to the teachings of the invention.

When the dimensions of the sheets are such that the ends terminate short of the end restraints an elongated member may be mounted on the plate of the base, for example, a wooden member may be nailed to the base against the ends of the loaded sheets to restrain longitudinal motion of the sheets. In the alternative, dunnage may be provided between the ends of the loaded sheets and the end restraints to take up space therebetween. Further, when less than a full load of sheets are on a rack, the space between the gate and the outermost sheet may be filled with dunnage. Any type of dunnage, e.g. wood, cardboard of plastic materials may be used. Shown in FIG. 2 is an adjustable element 350 incorporating features of the invention that may be used as dunnage. The dunnage member 350 includes a base member 352 having a flat back surface 353 which engages the plate 62 of the gate 68 or 168 and a groove 354 for receiving protrusion 356 of intermediate member 358. The intermediate member 358 may be shorter in length than the base member 352 for use on racks having tiers as shown in FIG. 11 and any number of intermediate members may be used to provide the dunnage member 350 with a predetermined thickness. The intermediate member 358 has a groove 360 for receiving protrusion 356 of adjacent intermediate member 358 or protrusion 364 of end member 362. The protrusion 364 of the end member 362 is mounted in the groove 354 of the base member 352 when no intermediate members are used. Flat surface 366 of the end member 362 is mounted in surface engagement with the outermost loaded sheet.

As can now be appreciated the invention is not limited to the types of sheets that are loaded on the racks, e.g. the sheets may be glass sheets, wooden sheets, plastic sheets and/or metal sheets. Further, when the loaded sheets are easily marred, e.g. glass sheets, it is recommended that all surfaces contacting the sheets be provided with a nonmarring material, e.g. rubber, cardboard or plastic. Still further, the above examples are presented for illustration purposes only and are not limiting to the invention.

What is claimed:

1. A rack for shipping sheets, comprising:

a base having a front half portion and a rear half portion;

a pair of vertical standards mounted in spaced relation to one another on the rear half portion of said base and extending above said base;

a pair of vertical legs mounted in spaced relation to another on the front half portion of said base, said pair of legs having a height less than the height of said pair of standards;

a planar sheet supporting member having a configuration and cross-sectional area;

means for securing said planar sheet supporting member to said pair of standards to support the sheets to be shipped in a generally vertical position;

a planar sheet retaining member having a configuration and cross-sectional area similar to that of said planar sheet supporting member;

a pair of elongated vertical members mounted in spaced relation to one another to said planar sheet retaining member;

means for detachably securing said pair of elongated vertical members to said pair of legs to position said planar sheet retaining member in spaced facing relationship to said planar sheet supporting member; and means mounting said pair of vertical standards and said pair of elongated vertical members and detachably secured to at least one of said pair of vertical standards or said pair of vertical members for maintaining said planar sheet retaining member in a fixed spaced relationship to said planar sheet supporting member.

2. The rack as set forth in claim 1 wherein said base includes:

a first strut secured to and between one of said standards and one of said legs;

a second strut secured to and between said remaining standard and said remaining leg;

a first stringer secured to and between said pair of legs; and a second stringer secured to and between said pair of standards.

3. The rack as set forth in claim 2 wherein said base further includes:

a plurality of third stringers mounted between said first and second stringers and between said first second pair of struts.

4. The rack as set forth in claim 2 further including support means secured to each of said first and second struts.

5. The rack as set forth in claim 4 where each of said support means includes:

a first elongated member having its longitudinal axis aligned with the longitudinal axis of said first stringer;

a second elongated member having its longitudinal axis aligned with the longitudinal axis of said second stringer; and a third elongated member having its longitudinal axis normal to the longitudinal axis of said first and second elongated members.

6. The rack as set forth in claim 5 wherein said base further includes a plate member supported by selected ones of said struts, stringers and elongated members.

7. The rack as set forth in claim 1 further including at least one rail mounted to and below said base.

8. The rack as set forth in claim 7 wherein a rail is mounted below said first and second stringers and extends beyond bottom end portions of said legs and standards.

9. The rack as set forth in claim 7 or 8 wherein said rail below said first stringer slopes toward said second stringer and said rail below said second stringer slopes toward bottom portion of said standards.

10. The rack as set forth in claim 1 wherein said planar sheet supporting member and supporting surface of said base subtend an oblique angle.

11. The rack as set forth in claim 10 wherein bottom edge of said planar sheet supporting member is spaced from said supporting surface of said base to provide a rail receiving portion, side portions of said planar sheet supporting member are spaced from said standards to provide standard receiving portions and further including first and second support rails below and angled relative to said base such that nesting a first rack in a second rack sets the standards of the first rack in the standard receiving portions of the second rack and said second rail of the first rack in said rail receiving portion of the second rack with said first and second rails of the first rack supported on said surface of said base of said second rack.

12. The rack as set forth in claim 1 wherein said base includes at least one hole and further including at least one elongated bar having an end portion insertable in said hole of said base and said opposite end pivotally attached to one of said vertical members.

13. The rack as set forth in claim 12 wherein said planar sheet supporting member is sloped relative to said base.

14. The rack as set forth in claim 1 wherein said maintaining means includes:

an elongated bar secured at one end to one of said vertical standards and the other end to one of said vertical members.

15. The rack as set forth in claim 14 wherein said bar is pivotally mounted to said vertical standard and further including means for detachably securing the other end of said bar to said vertical member.

16. The rack as set forth in claim 15 wherein said detachably securing means includes:

a hole in said bar;

a headed stud mounted on said bar;

a groove in said vertical member for receiving said headed stud; and a biasing pin assembly having a pin insertable in said hole of said bar.

17. The rack as set forth in claim 15 wherein said detachably securing means includes:

a groove in said bar;

a hole in said bar;

a stud mounted in said post insertable in said groove; and a bias pin assembly having a pin insertable in said hole of said bar.

18. The rack as set forth in claim 1 further including an end restraint mounted on each of opposed sides of said base to restrain longitudinal displacement of the sheets.

19. The rack as set forth in claim 18 wherein each of the end restraints:

a plate;

means for pivotally mounting one end of said plate to said base; and means for detachably securing the other end to the side of said base.

20. The rack as set forth in claim 19 wherein said detachably securing means of said end restraint includes:

a hooking member mounted on said end restraint;

a hole in said plate; and a biasing pin assembly on said rack having a pin insertable in said hole of said plate.

21. The rack as set forth in claim 18 wherein each of said end restraints includes a plate having a pair of spaced rods slideable into the side of said rack and means for securing the end restraints in one of a plurality of selected positions.

22. The rack as set forth in claim 19 wherein said means for pivotally mounting said plate include:

a rod slideably and rotatably mounted in said base; and said means for detachably securing said plate to said base includes a member having a plurality of grooves of which selected ones are engageable with said base to prevent slideable motion of said plate and further including means acting on said rod for preventing rotational motion of said plate.

23. The rack as set forth in claim 18 wherein said front restraint includes a post and said backwall includes a standard and an end restraint includes a rigid bar having shaped ends for engaging said post of said front restraint and said standard of said backwall.

24. The rack as set forth in claim 1 further including a plate slideably mounted on the base to alter the dimensions of the base and means for detachably securing said plate in one of a preselected number of positions.

25. The rack as set forth in claim 24 wherein said detachably securing means includes a pair of spaced rods mounted on said plate and slideable in said base of said rack, said rods having a plurality of holes for receiving a pin passing through said base and said holes of said rod to position said plate in one of a selected number of positions.

* * * * *